United States Patent [19]

Yamazaki et al.

[11] 4,052,643

[45] Oct. 4, 1977

[54] ELECTRON GUNS FOR USE IN CATHODE RAY TUBES

[75] Inventors: Eiichi Yamazaki, Ichihara; Hiromi Kanai; Toshio Hurukawa, both of Mobara, all of Japan

[73] Assignee: Hitachi, Ltd., Tokyo, Japan

[21] Appl. No.: 710,590

[22] Filed: Aug. 2, 1976

Related U.S. Application Data

[60] Division of Ser. No. 534,646, Jan. 23, 1975, Continuation of Ser. No. 349,065, April 9, 1973.

[30] Foreign Application Priority Data

Apr. 12, 1972 Japan ..... 47-42438

[51] Int. Cl.[2] ..... H01J 29/46; H01J 29/56

[52] U.S. Cl. ..... 315/16; 313/414; 313/449

[58] Field of Search ..... 315/15, 16, 14; 313/414, 449

[56] References Cited

U.S. PATENT DOCUMENTS 3,651,359 3/1972 Miyaoka ..... 315/15

*Primary Examiner*—Maynard R. Wilbur
*Assistant Examiner*—T. M. Blum
*Attorney, Agent, or Firm*—Charles E. Pfund

[57] ABSTRACT

In an electron gun for use in a cathode ray tube of the class wherein a main electron lens system is constituted by a plurality of discrete electron lens systems, the plurality of electron lens systems are of the unipotential type and the intensity of the preceding lens system is made larger than that of the succeeding lens system.

7 Claims, 3 Drawing Figures

ELECTRON GUNS FOR USE IN CATHODE RAY TUBES

This is a division of application Ser. No. 534,646 filed Jan. 23, 1975.

BACKGROUND OF THE INVENTION

This invention relates to an electron gun, and more particularly to an electron gun for use in cathode ray tubes.

The main lens of an electron gun utilized in a cathode ray tube is generally classified into two types, that is the bipotential type and the unipotential type. In the case of the bipotential type main lens, it is possible to form a sharply defined beam spot but as the beam current increases, the quality of the beam spot is gradually degraded. In the case of the unipotential type main lens, the quality of the beam spot is not influenced by the beam current, but the beam spot is not sharply defined. Consequently, with these types of the main lenses, if one tries to decrease the size of the beam spot, the aberration would tend to increase. For this reason, there is a limit for the sharpness of the beam spot.

It has also been proposed to construct a main lens system from a plurality of discrete lens systems so as to successively focus an electron beam by the discrete lens systems. However, as this construction requires a number of lens systems, it is necessary to lengthen the length of the electron gun.

In each of the prior art electron guns, as the electron lens system is designed such that the electron beam will pass through a region outside the near axis region of the electron lens system that is the portions remote from the optical axis of the electron lens, if one tries to obtain a high density electron beam, the aberration of the electron lens system will be increased thus making it difficult to form a sharply defined beam spot on a fluorescent screen.

SUMMARY OF THE INVENTION

Accordingly, it is an object of this invention to provide an improved electron gun for use in a cathode ray tube.

A further object of this invention is to provide an improved electron gun capable of forming a sharply defined electron beam spot without increasing aberration.

According to this invention these and other objects can be accomplished by providing an electron gun for use in a cathode ray tube comprising a combination of a plurality of unipotential type electron lens systems, wherein the intensity or the beam focusing power of the lens system in the preceding stage is made to be larger than that of the lens system in the succeeding stage.

DESCRIPTION OF THE PREFERRED EMBODIMENTS

Figure 1:
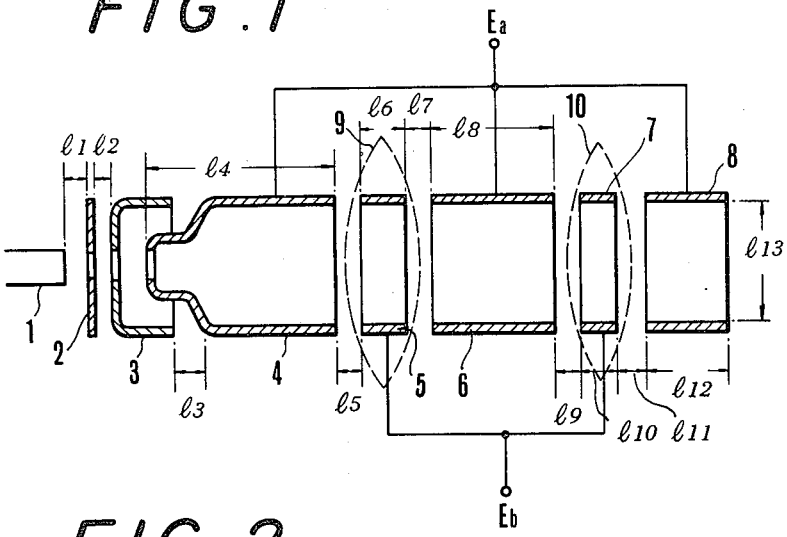
FIG. 1 shows a schematic longitudinal section of an electron gun embodying the invention.

A preferred embodiment shown in FIG. 1 comprises a cathode electrode 1 and from the first to the seventh control electrodes 2 through 8, of which the third control electrode 4, the fifth control electrode 6 and the seventh control electrode 8 are connected to a source of high voltage Ea having a voltage of from 10 to 30 KV whereas the fourth control electrode 5 and the sixth control electrode 7 are connected to a focusing source Eb having a voltage of from 0 to 6 KV. Control electrodes 4 through 8 constitute two unipotential type electron lens systems 9 and 10. According to this invention, the intensity or the beam focusing power of the lens system 9 constituting the first stage of the lens system is made to be larger than that of the lens system 10 constituting the second stage. Thus, the main electron lens system is constituted by these two lens systems 9 and 10. More particularly, in accordance with this invention, the main electron lens system of the electron gun is comprised by two unipotential type electron lens systems 9 and 10 which are less susceptive to the effect of the variations in the high voltage and the intensity of the first stage lens system 9 located closer to the cathode elecrode 1 is made to be larger than that of the second stage lens system 10 thereby causing the electron beam to pass through regions close to the axis of the electron gun.

With this design, the electron beam entering into the main electron lens system from a prefocusing system is strongly refracted and its diameter is decreased. In addition, as the electron beam is gradually focused by two electron lens systems 9 and 10, it is possible to form more sharply defined beam spot than the conventional electron gun without increasing the aberration. Furthermore, as the main electron lens system is comprised by two lens systems it is possible to construct the main electron lens system to have a substantially large electrode opening so that the aberration can be decreased further.

As above described, the invention provides an electron gun having a small aberration, particularly for an electron beam of high density, and can form a sharply defined beam spot.

The feature of this invention, that is the object of making the intensity of the first stage lens system to be larger than that of the second stage lens system can be accomplished by 1. increasing the length of an particular electrode among electrodes comprising the first stage electron lens system to which a low voltage is impressed, that is the length $_6$ of the fourth control electrode 5 shown in FIG. 1 or by
2. increasing the spacings between control electrodes comprising the first stage electron lens system, that is the spacings $_5$ and $_7$ between the third and fourth control electrodes 4 and 5 and between the fourth and fifth control electrodes 5 and 6.

In the case of an electron gun for use in a colour picture tube, various electrodes shown in FIG. 1 have following dimensions.

EXAMPLE 1.

$l_1 = 0.19$ mm, $l_2 = 0.25$ mm, $l_3 = 1.1$ mm, $l_4 = 6.8$ mm, $l_5 = 1.4$ mm, $l_6 = 10.0$ mm, $l_7 = 1.4$ mm, $l_8 = 28$ mm, $l_9 = 1.4$ mm, $l_{10} = 3.4$ mm, $l_{11} = 1.4$ mm, $l_{12} = 9.5$ mm, and $l_{13} = 8.9$ mm.

EXAMPLE 2.

$l_1 = 0.19$ mm, $l_2 = 0.25$ mm, $l_3 = 1.1$ mm, $l_4 = 6.8$ mm, $l_5 = 2.4$ mm, $l_6 = 6.0$ mm, $l_7 = 2.4$ mm, $l_8 = 28$ mm, $l_9 = 1.4$ mm, $l_{10} = 6.0$ mm, $l_{11} = 1.4$ mm, $l_{12} = 9.5$ mm and $l_{13} = 8.9$ mm.

Instead of connecting the fourth control electrode 5 and the sixth control electrode 7 to common source Eb, it is also possible to connect these control electrodes 5 and 7 to different focusing sources $Eb_1$ and $Eb_2$ having voltages of from 0 to 6 KV. In the same manner, the third, the fifth and seventh control electrodes 4, 6 and 8 may be connected to independent sources.

Figure 2:
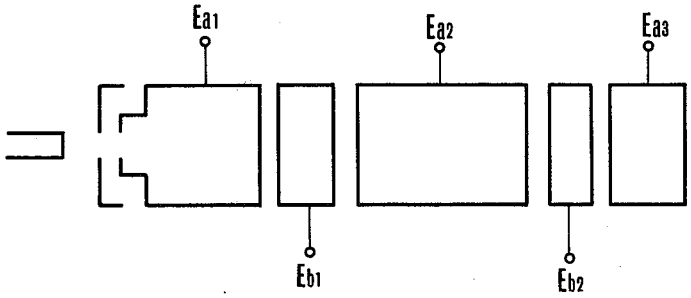
FIGS. 2 and 3 are diagrams showing another embodiments of this invention.

FIG. 2 diagrammatically shows such connection and the following table shows typical examples of the voltages of various sources.

Table

| Example | $Ea_1$ | $Ea_2$ | $Ea_3$ | $Eb_1$ | $Eb_2$ |
|---|---|---|---|---|---|
| 1 | 25 KV | 25 KV | 25 KV | 5.8 KV | 6.8 KV |
| 2 | 30 | 30 | 30 | 9.4 | 9.4 |
| 3 | 13 | 13 | 13 | 4.2 | 4.2 |
| 4 | 30 | 25 | 25 | 8.6 | 6.8 |
| 5 | 30 | 25 | 20 | 8.6 | 5.4 |

Although in the foregoing embodiment the main electron lens was comprised by two bipotential type electron lens systems it should be understood that the invention is by no means limited to this construction but that the main electron lens system can also be constituted by a plurality of unipotential type electron lens systems so long as the intensity of the preceding lens system can be made to be stronger than that of the succeeding lens system. Again, it is possible to obtain a lens effect of substantially large diameter as in the foregoing embodiment, so that the electron beam passes through the region of small aberration.

Figure 3:
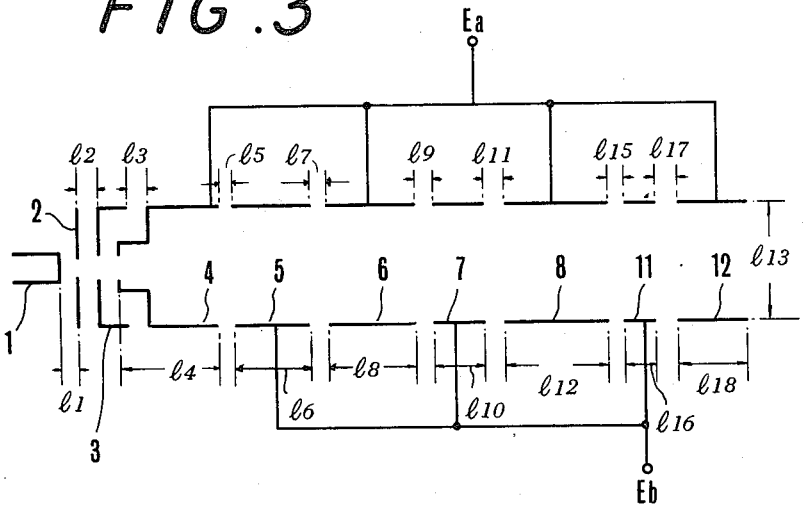

FIG. 3 shows such modification which is different from that shown in FIG. 1 in that additional electrodes 11 and 12 are added. Source Ea may have a voltage of from 12 to 30 KV and source Eb a voltage of from about 2.4 to 10 KV. The embodiment shown in FIG. 3 can also form a sharply defined electron beam spot without increasing the aberration. Typical dimensions of various portions are as follows.

$l_1 = 0.19$ mm, $l_2 = 0.25$ mm, $l_3 = 1.1$ mm, $l_4 = 7.8$ mm, $l_5 = 1.4$ mm, $l_6 = 8.0$ mm, $l_7 = 1.4$ mm, $l_8 = 10.0$ mm, $l_9 = 1.4$ mm, $l_{10} = 5.0$ mm, $l_{11} = 1.4$ mm, $l_{12} = 10.0$ mm, $l_{13} = 8.9$ mm, $l_{15} = 1.4$ mm, $l_{16} = 3.4$ mm, $l_{17} = 1.4$ mm, and $l_{18} = 9.5$ mm.

Although the invention has been shown and described in terms of some peferred embodiments thereof it should be understood that many changes and modifications will be obvious to one skilled in the art without departing from the true spirit and scope of the invention as defined in the appended claims.

What is claimed is:

1. In a cathode ray tube image system an electron gun in a cathode ray tube comprising a single gun monobeam electron source and a main electron lens combination aligned on the axis of said gun which includes first and second axially aligned independent electron lens systems having a common electrode therebetween, each independent electron lens system including three electrodes including said common electrode arranged in sequence on substantially the same axis with said common electrode being the last electrode of said first lens system and the first electrode of the succeeding said second lens system, an intermediate electrode of said three electrodes in each said system having an applied voltage lower than that applied to the other electrodes of said electron lens system, and means including voltage supply means for said electrodes for making the beam focusing power of said first of said electron lens systems closest to said source greater than that of succeeding lens systems more remote from said source.

2. The cathode ray tube image system according to claim 1, wherein the length of said intermediate electrode belonging to said one of said electron lens systems is made longer than that of the corresponding intermediate electrode belonging to the said succeeding electron lens system.

3. The cathode ray tube image system according to claim 1, wherein the spacing of electrodes in the said first electron lens system is larger than that between the electrodes in the other said electron lens systems.

4. The cathode ray tube image system according to claim 2 wherein each of said other electrodes is connected to one common voltage source having a higher voltage than that applied to said intermediate electrodes.

5. The cathode ray tube image system according to claim 3, wherein each of said other electrodes is connected to one common voltage source having a higher voltage than that applied to said intermediate electrodes.

6. The cathode ray tube image system according to claim 1, wherein both end electrodes of said first and said succeeding electron lens systems are connected to one common voltage source and said intermediate electrodes of said first and said succeeding electron lens systems are connected to another common voltage source having different voltage from that of said one voltage source.

7. The cathode ray tube image system according to claim 1 wherein said main electron lens system comprises said first and second electron lens systems and including a third such independent lens system in axial alignment succeeding said pair of independent electron lens systems.

* * * * *

UNITED STATES PATENT OFFICE

CERTIFICATE OF CORRECTION

Patent No. 4,052,643 Dated October 4, 1977

Inventor(s) Eiichi Yamazaki et al.

It is certified that error appears in the above-identified patent and that said Letters Patent are hereby corrected as shown below:

Column 2, line 19, "elecrode" should be -- electrode --.

Column 2, lines 47 and 51, insert --$\ell$ -- before the subscript numbers, each occurrence.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*